US010864425B2

(12) United States Patent
Moore

(10) Patent No.: US 10,864,425 B2
(45) Date of Patent: Dec. 15, 2020

(54) METHODS OF IMPROVING RESPIRATORY EFFECTIVENESS

(71) Applicant: Marion Octavia Sharon Moore, Surrey (GB)

(72) Inventor: Marion Octavia Sharon Moore, Surrey (GB)

( * ) Notice: Subject to any disclaimer, the term of this patent is extended or adjusted under 35 U.S.C. 154(b) by 0 days.

(21) Appl. No.: 15/590,505

(22) Filed: May 9, 2017

(65) Prior Publication Data

US 2017/0282049 A1 Oct. 5, 2017

Related U.S. Application Data

(63) Continuation-in-part of application No. 14/748,425, filed on Jun. 24, 2015, now abandoned, which is a continuation of application No. 13/606,535, filed on Sep. 7, 2012, now abandoned.

(51) Int. Cl.

| | |
|---|---|
| ***A63B 69/12*** | (2006.01) |
| ***A63B 23/18*** | (2006.01) |
| ***A63B 1/00*** | (2006.01) |
| *A63B 23/00* | (2006.01) |

(52) U.S. Cl.

CPC ..... *A63B 69/12* (2013.01); *A63B 1/00* (2013.01); *A63B 23/18* (2013.01); *A63B 2023/006* (2013.01); *A63B 2208/03* (2013.01); *A63B 2225/055* (2013.01); *A63B 2225/09* (2013.01)

(58) Field of Classification Search

CPC ... A63B 69/12; A63B 23/18; A63B 2023/006; A63B 2208/03; A63B 2225/055

USPC ..... 482/13, 51, 55

See application file for complete search history.

(56) References Cited

U.S. PATENT DOCUMENTS

| | | | | |
|---|---|---|---|---|
| 3,587,123 | A * | 6/1971 | O'Boyle | B63B 27/14 114/362 |
| 3,724,012 | A * | 4/1973 | Sanderson | A63B 69/12 441/55 |
| 3,859,990 | A * | 1/1975 | Simon | A61H 1/0218 601/157 |
| 4,218,056 | A * | 8/1980 | Whitling | A63B 69/12 434/254 |
| 4,712,788 | A * | 12/1987 | Gaudreau, Jr. | A63B 22/02 4/496 |
| 4,971,317 | A * | 11/1990 | Link | A63B 22/0694 482/57 |
| 5,050,863 | A * | 9/1991 | Yacoboski | A63B 21/00047 4/496 |

(Continued)

OTHER PUBLICATIONS

Colorful grab barWebsite:https://web.archive.org/web/20151123074650/http://www.store.adaptivelivingstore.com/colored-grab-bars-c184.aspxarchived: Nov. 23, 2015; retrieved: Mar. 12, 2019 (Year: 2015).*

(Continued)

*Primary Examiner* — Megan Anderson

(74) *Attorney, Agent, or Firm* — Fredrikson & Byron, P.A.

(57) ABSTRACT

Methods for improving respiratory effectiveness including inhaling a breath and, while continuously holding the breath, swimming for a period of at least 10 seconds without exhaling or further inhaling, and inhaling a breath and, without exhaling or further inhaling, adopting, and holding for a period of at least 3 seconds, at least one stretch position, which requires constant muscular exertion to maintain.

8 Claims, 11 Drawing Sheets

(56) References Cited

U.S. PATENT DOCUMENTS

| | | | | |
|---|---|---|---|---|
| 5,306,217 | A * | 4/1994 | Bracone | A63B 1/00 4/496 |
| 5,601,514 | A * | 2/1997 | Horn | A63B 69/12 434/254 |
| 6,179,759 | B1 * | 1/2001 | Tellone | A63B 23/0211 482/111 |
| 7,104,932 | B1 * | 9/2006 | Brentlinger | A63B 69/12 434/254 |
| 7,641,590 | B2 | 1/2010 | Chan | |
| 7,787,943 | B2 | 8/2010 | McDonough | |
| 8,341,765 | B2 | 1/2013 | Brodbeck | |
| 8,406,085 | B2 | 3/2013 | Sakita | |
| 9,480,367 | B2 * | 11/2016 | Reed | A47K 17/022 |
| 9,827,477 | B2 * | 11/2017 | Stacey | A63B 21/0084 |
| 2010/0151428 | A1 * | 6/2010 | Lazarev | A63B 69/12 434/254 |
| 2010/0304934 | A1 | 12/2010 | Woodson | |
| 2014/0148077 | A1 * | 5/2014 | Hunter | A63H 33/42 446/153 |
| 2016/0090782 | A1 * | 3/2016 | Kwoka | E06C 1/12 182/207 |
| 2017/0361192 | A1 * | 12/2017 | Portnof | A63B 69/12 |

OTHER PUBLICATIONS

Telescopic Grab bar website:https://www.amazon.com/Grab-Bars-telescoping-portable-bathroom/dp/B001Q1NIKQ published date: Jan. 18, 2009 retrieved: Mar. 12, 2019 (Year: 2009).*

Grab bar website: Website: https://web.archive.org/web/20170329165041/https://www.homedepot.com/p/No-Drilling-Required-42-in-x-1-1-2-in-Grab-Bar-in-Brushed-Stainless-Steel-GB38042-SS-NDR/202819525 archived: Mar. 29, 2017; retrieved: Mar. 12, 2019 (Year: 2017).*

How to Stretch for Swimming, May 1, 2012: http://www.fitday.com/fitness-articles/fitness/stretching/how-to-stretch-for-swimming.html, found Mar. 18, 2014.

Popular Swimming Workouts, Mar. 3, 2008 archived: http://web.archive.org/web/20080303200706/http://www.military.com/military-fitness/workouts/popular-swimming-workouts, found: Mar. 18, 2014.

Swimming Workout, May 7, 2010 archived: http://www.womenshealthmag.com/style/swim-workout?page=2, found Mar. 18, 2014.

Synchronized Swimming, Jan. 16, 2008 archived: http://serendip.brynmawr.edu/exchange/node/1847, found Mar. 18, 2014.

https://web.archive.org/web/20030622192458/http:/www.bodybuilding.com/fun/maia3.htm; Retrieved: Sep. 16, 2014; Date: Jun. 22, 2003.

http://www.ncbi.nlm.nih.gov/pubmed/19046177 Retrieved: Sep. 16, 2014 Date: Nov. 2008.

https://web.archive.org/web/20100412121919/http:/www.claremontclub.com/Group-Exercise/Aqua-Classes.asp Retrieved: Sep. 16, 2014 Date: Apr. 12, 2010.

https://web.archive.org/web/20100417141129/http:/www.spine-health.com/wellness/exercise/water-therapy-exercises Retrieved: Sep. 16, 2014 Date: Apr. 17, 2010.

https://web.archive.org/web/20060322000000/http:/en.wikipedia.org/wiki/Underwater_rugby Retrieved: Sep. 16, 2014 date: Mar. 22, 2006.

https://web.archive.org/web/20080317083746/http:/en.wikipedia.org/wiki/Water_aerobics Retrieved: Sep. 16, 2014 Date Mar. 17, 2008.

https://web.archive.org/web/20110629074711/http:/en.wikipedia.org/wiki/Aquatic_therapy Retrieved: Sep. 16, 2014 Date: Jun. 29, 2011.

Rogers, Chris Dineson, Respiratory Muscle Strength Training, Mar. 9, 2014, http://www.livestrong.com/article/297742-respiratory-muscle-strength-training/.

Powerbreathe; http://www.powerbreathe.com; Retrieved Feb. 17, 2015.

Anderson, Owen, Cardiovascular Endurance: respiratory training can improve performance; http://www.pponline.co.uk/encyc/cardiovascular-endurance-respiratory-training-can-improve-performance-70#, Retrieved Feb. 17, 2015.

Swatmarama, Hathapradipika: Edited by Swami Digambaraji & Pt. Raghunatha Shastri Kokaje, 2nd Edition, 1998, pp. 4-7.

Swatmarama, Hathapradipika: Edited by Swami Digambaraji & Pt. Raghunatha Shastri Kokaje, 2nd Edition, 1998, pp. 8-14.

Agnipurana: Commentary by Acharya Shiv Prasad Dwivedi, 1st Edition, 2004, pp. 15-18.

* cited by examiner

METHODS OF IMPROVING RESPIRATORY EFFECTIVENESS

PRIORITY CLAIM

This application is a continuation-in-part of U.S. patent application Ser. No. 14/748,425, filed Jun. 24, 2015, which is a continuation of U.S. patent application Ser. No. 13/606,535, filed Sep. 7, 2012, now abandoned, which claims priority to UK patent application no. 1115610.6, filed Sep. 9, 2011, entitled "A Training Method and Regime", the disclosure of which is hereby incorporated by reference.

FIELD

Embodiments of the invention relate to methods for improving respiratory effectiveness, and in particular concern training methods and techniques for improving overall breathing performance and recovery rates.

BACKGROUND

In sports and other activities that subject the human body to stress and exertion, effective breathing is vital, and the preparation for many sports includes repetitive and strenuous training to improve cardio-vascular fitness. Shortness of breath, or the inability to regain control of one's breathing following a period of exertion, are often factors which limit an individual's sporting performance.

There is a need for improved methods and techniques for improving the effectiveness of individuals' breathing, over and above the simple repetition of strenuous endurance activity.

SUMMARY

Accordingly, one aspect of the present invention provides a method for improving respiratory effectiveness, including the steps of: inhaling a breath and, holding the breath, swimming for a period of at least 10 seconds without exhaling or further inhaling; inhaling a breath and, without exhaling or further inhaling, adopting, and holding for a period of at least 3 seconds, at least one stretch position, which requires constant muscular exertion to maintain.

Advantageously, the two steps are carried out successively, with a period of no more than 60 seconds between completing one of the steps and commencing the other of the steps.

Preferably, the swimming step comprises swimming underwater or swimming along the surface of the water.

Conveniently, the swimming step is completed using a stroke in which the subject's arms are primarily used to drive the subject through the water, with the subject's legs not contributing significantly to the subject's locomotion.

Advantageously, the stretching step comprises successively adopting and holding two or more stretch positions, each for a period of at least 3 seconds.

Preferably, a separate breath is inhaled and held for each of the two or more stretch positions.

Conveniently, the stretching step is carried out with at least the subject's mouth and nose submerged under the surface of the water.

Advantageously, the swimming step comprises swimming a length or width of a swimming pool.

Preferably, the pool is a 25-meter or 50-meter pool.

Conveniently, the stretching step comprises holding a stretch position for at least 15 seconds.

Advantageously, the method comprises alternately carrying out the stretching step and the swimming step at least 10 times each.

Preferably, the method comprises alternately carrying out the stretching step and the swimming step at least 15 times each.

Another aspect of the present invention provides a training programme comprising any of the above methods.

BRIEF DESCRIPTION OF THE FIGURES

In order that the present invention may be more readily understood, embodiments thereof will now be described, with reference to the accompanying figures. The figures are illustrative of particular embodiments of the present invention and therefore do not limit the scope of the invention. The figures are intended for use in conjunction with the explanations in the following detailed description. Embodiments of the present invention will hereinafter be described in conjunction with the appended photographs.

DETAILED DESCRIPTION OF ILLUSTRATIVE EMBODIMENTS

Figure 1:
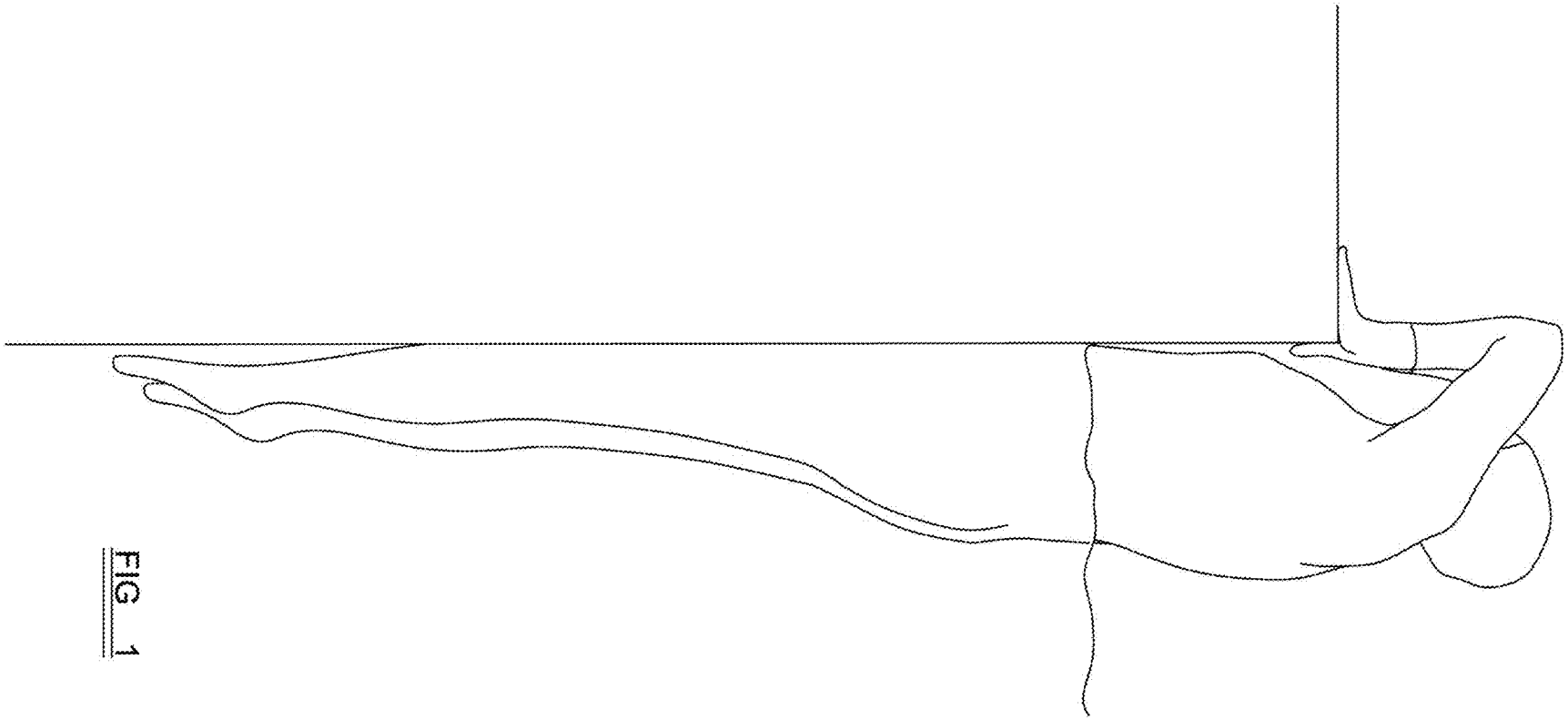
FIGS. 1 to 12 show various "stretch and hold" positions that are suitable for use with the present invention.
Figure 2:
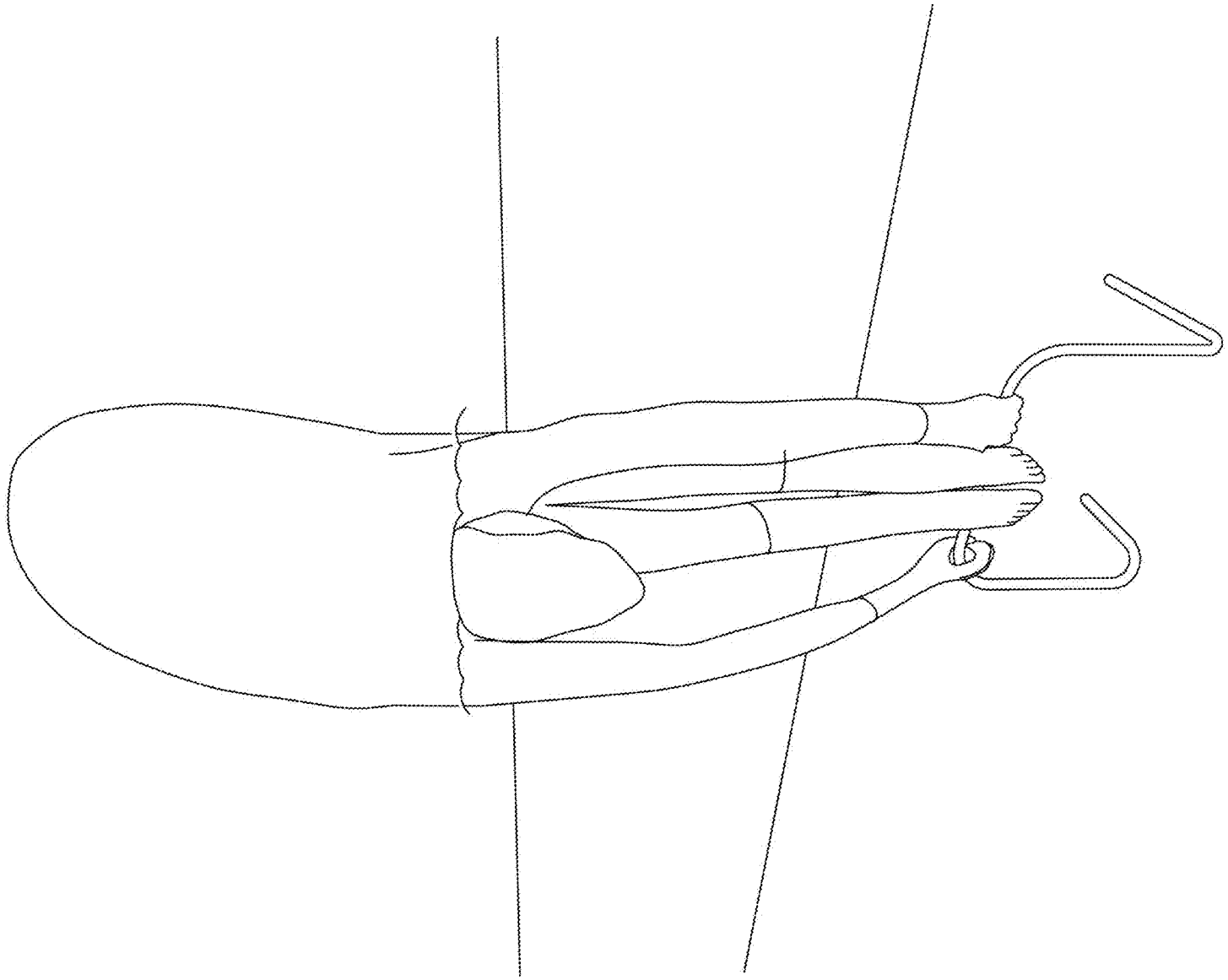
Figure 3:
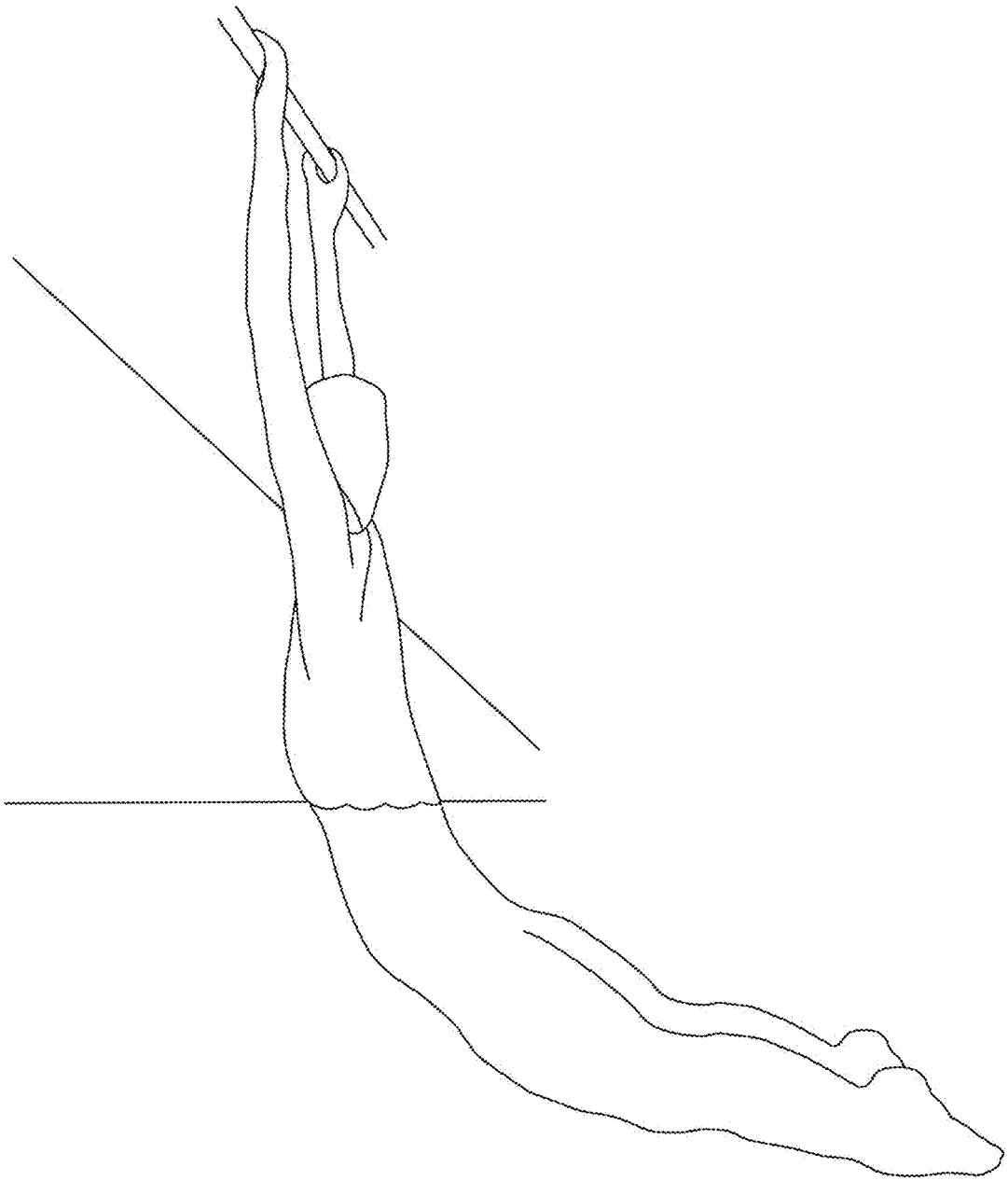
Figure 4:
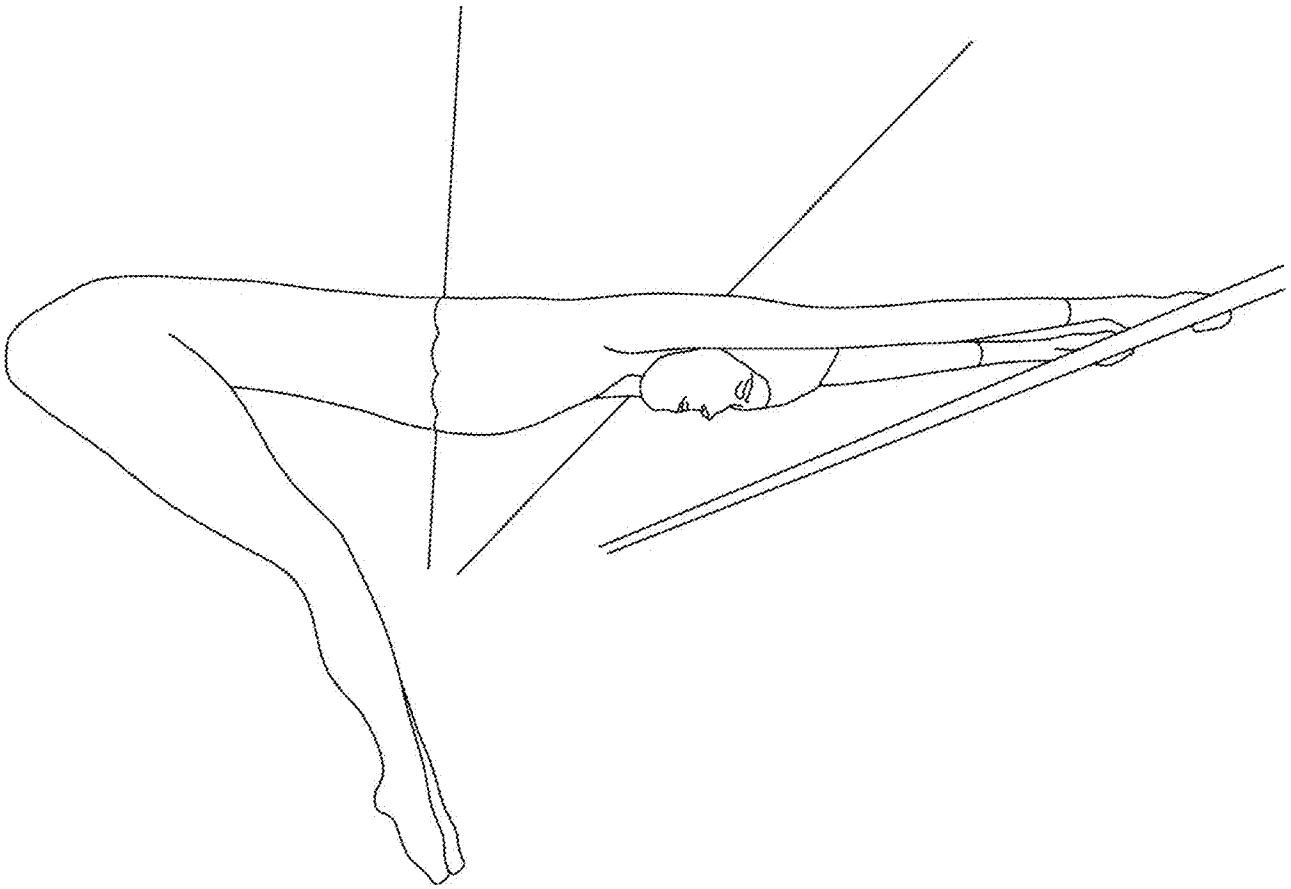
Figure 5:
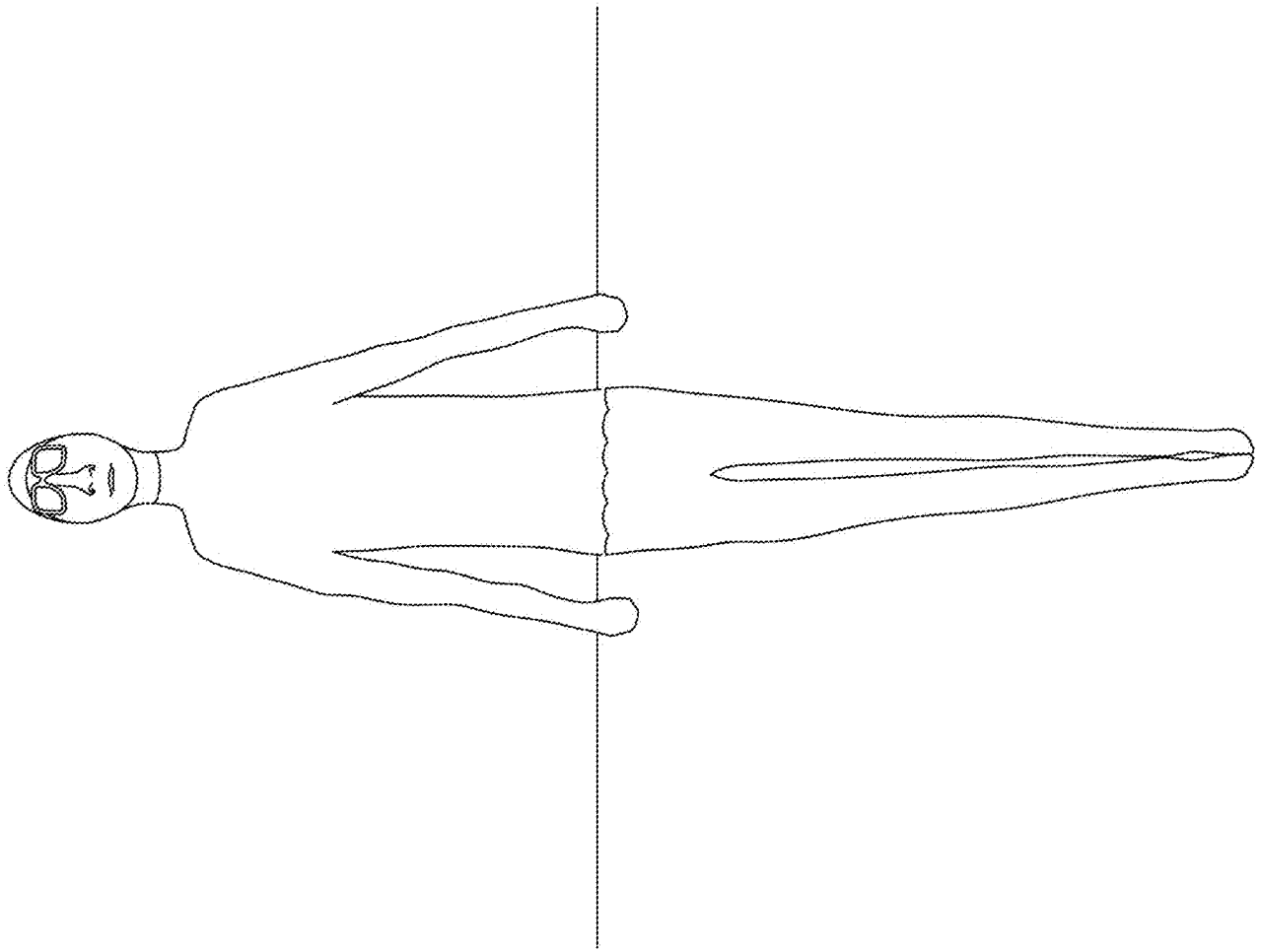
Figure 7:
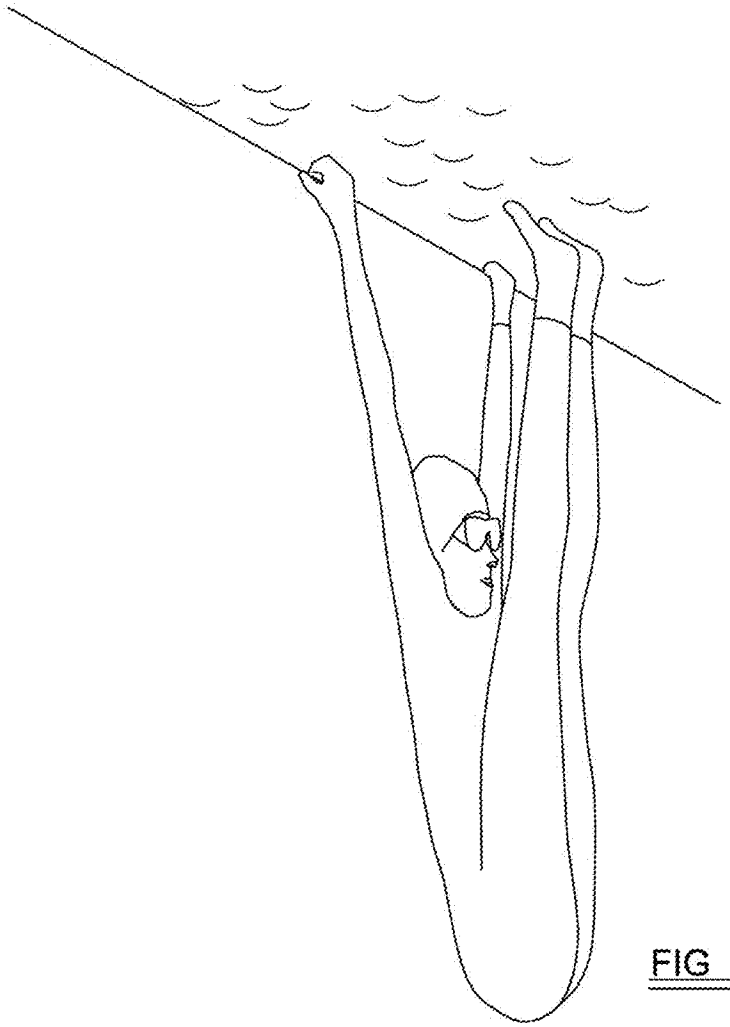
Figure 6:
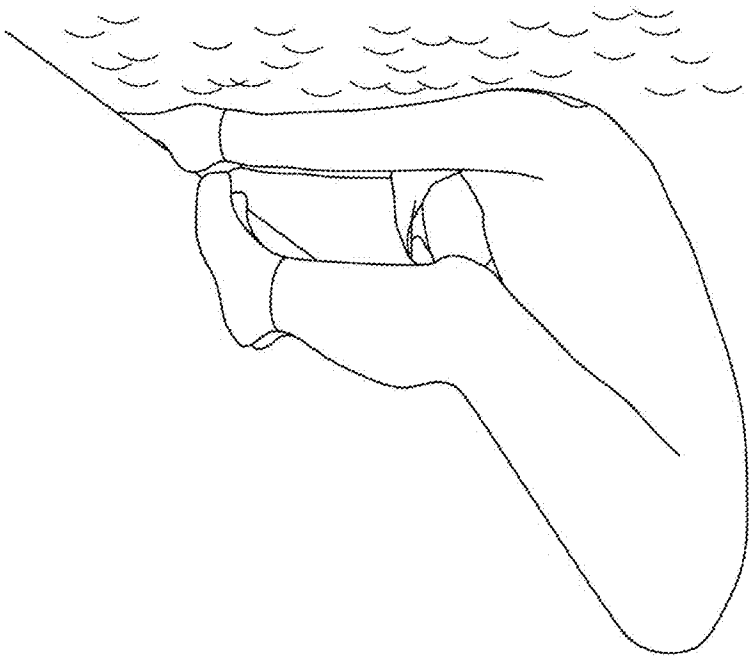
Figure 8:
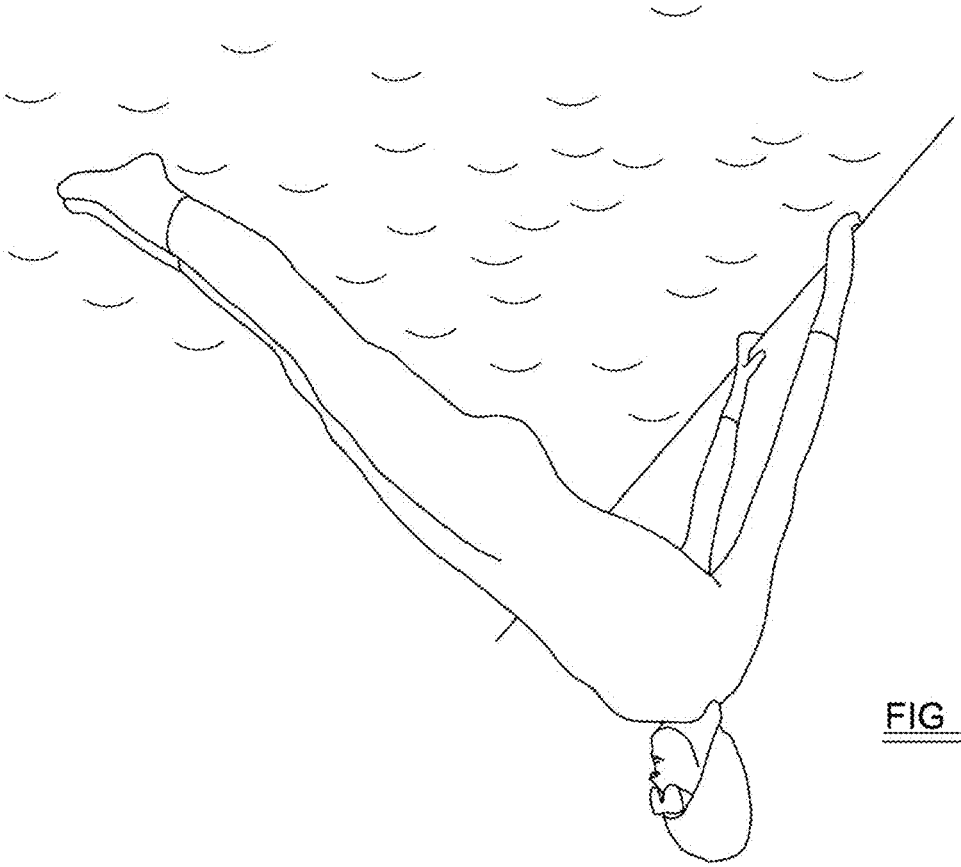
Figure 9:
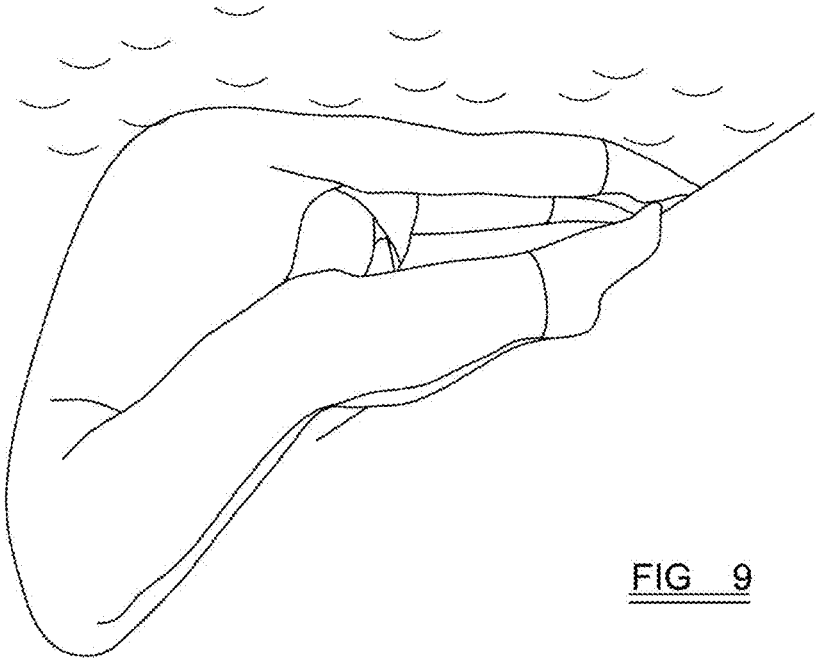
Figure 11:
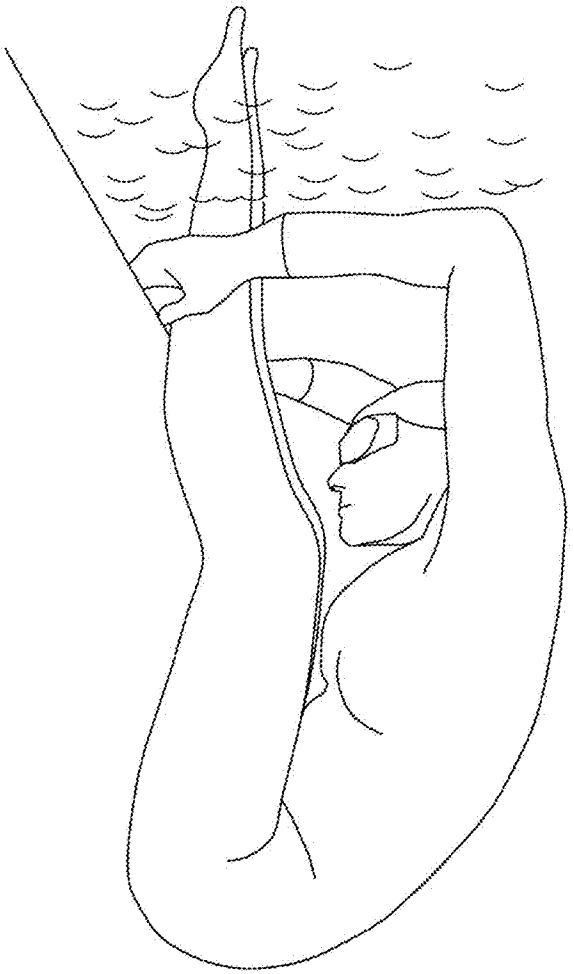
Figure 10:
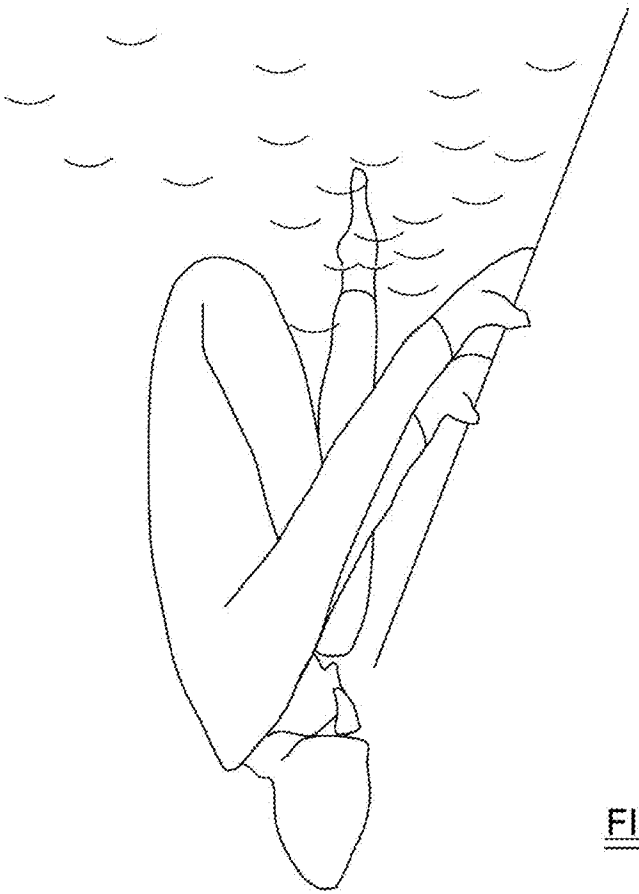

The following detailed description is exemplary in nature and is not intended to limit the scope, applicability, or configuration of the invention in any way. Rather, the following description provides practical illustrations for implementing exemplary embodiments of the present invention. Those skilled in the art will recognize that many of the examples provided have suitable alternatives that can be utilized.

Training methods embodying the present invention aim to improve the respiratory effectiveness of individuals, and this improved effectiveness will be useful in many circumstances, including, but not limited to: sports which involve sustained aerobic exertion, such as athletics, football and rugby; sports which do not (or do not always) involve sustained aerobic exertion, such as kinds of dance, gymnastics or weightlifting; the playing of musical wind instruments; all kinds of singing; performative speaking, such as acting and public speaking; and more general physical composure. While the methods disclosed herein are likely to have benefits for swimmers (swimming generally being an example of a sport which involves sustained aerobic exertion), the methods disclosed herein are not swimming exercises. For various reasons, steps of the training methods are generally carried out in a body of water, such as a swimming pool. Certain steps of the training methods require that an individual does not inhale or exhale, and if a subject's face is underwater then this helps to make sure that no inhalation takes place, and also makes it easy to verify that no exhalation takes place.

Having one's body fully or partly submerged in water also makes a wide variety of stretch positions possible (or less difficult)—on consideration of some of the stretch positions shown in the attached figures, which are discussed in more detail below, it will be clear to the skilled reader that it would not be straightforward for many of these positions to be adopted and sustained on dry land.

Furthermore, being submerged in water causes one's heart rate to slow down. This means that, during the stretch exercises, less oxygen is used (per unit time) by a person carrying out the training. This will help a subject to avoid becoming very short of breath during the training, and will also allow the lungs to remain full of a breath of air for as long as possible, with the chest cavity expanded, which (as discussed below) is crucial for developing the muscles around the lungs in the chest cavity.

Overall it will be clear that the methods disclosed herein are, despite the fact that they are generally carried out in a swimming pool or other body of water, not exercises in swimming training, and should not be mistaken for such. Rather, the methods discussed in this document are specifically geared towards the improvement of respiratory effectiveness for individuals.

Training methods embodying the invention vary in complexity, but comprise two main steps.

In a first step of the invention, the subject performs at least one "stretch and hold" exercise. During each of these exercises, an inhaled breath is held, without inhalation or exhalation.

The first step may comprise several successive stretch and hold exercises, and a new breath may be inhaled before each of these exercises, or indeed a single breath may be held for the duration of two or more of the stretch and hold exercises.

If the subject is at least partly submerged in water, it is preferred that the stretch and hold exercises are performed with at least the subject's mouth and nose submerged in the water, to ensure that no inhalation or exhalation takes place.

While the exact nature of the one or each stretch and hold position that is adopted during the first step is not critical, it is important that the position requires continuous effort on the part of the subject to maintain, i.e. it is not a "passive" position that can be maintained without effort. An example of such a passive position is one where the position is primarily maintained by the weight of the subject's body.

It is preferred that, in the one or each position adopted during the first step, the torso of the subject remains relatively straight, so that the expansion of the subject's lungs is not impeded. Positions in which the lungs are compressed, such as where the subject's back is significantly curled forwards or arched backwards, should preferably be avoided.

While the subject maintains the stretch and hold position, blood is forced into the muscles surrounding the lungs, i.e. those muscles (including, but not limited to, the extrinsic muscles and the diaphragm) which allow the subject's lungs to be held in the "fully inhaled" position. During this step, therefore, these muscles can be significantly developed, particularly if the subject is already physically exerted and hence the levels of oxygen in the subject's blood are relatively low.

Each stretch and hold position should be held for at least 3 seconds. More advanced training may involve positions being maintained for considerably longer than this, as will be clear from the examples given below.

In a second step, an individual inhales, preferably so that his or her lungs are full or substantially full of air, and then performs physical exercise while holding the inhaled air, i.e. without substantially inhaling or exhaling (aside from very small, inconsequential inhalations or exhalations).

The type and duration of the physical exercise that is performed during the first step will vary, depending on the level of fitness and experience of the subject, and also upon the intensity of training that is required. However, in general, the subject should become physically exerted during the exercise, so that he or she feels short of breath.

It is envisaged that the physical exercise carried out in the second step should last, for those of a low level of ability (e.g. subjects with a low level of fitness, or children), for at least 10 seconds. Again, fitter and more experienced subjects may perform physical exercise for considerably longer than this.

Performing physical exercise, while holding an inhaled breath and without inhaling or exhaling, causes exertion of (inter alia) the muscles surrounding the subject's lungs.

The first and second steps may be carried out in reverse order, i.e. the second step followed by the first step. However, both steps must be carried out in a training regime embodying the present invention. The steps must also be carried out without significant delay or rest therebetween. In preferred embodiments, there is a period of no more than 60 seconds between the completion of one step and the commencement of the other. More preferably this period is no more than 30 seconds, and even more preferably this period is no more than 10 seconds.

A training regime embodying the present invention may involve repeatedly carrying out exercises including the first and second steps, as outlined above. Performing training of this nature over extended periods has been found to improve breathing performance dramatically, as compared to standard endurance training (including swimming training), the performance of stretching exercises, or a combination of the two.

Carrying out training in accordance with the invention allows individuals to perform endurance sports more effectively for longer, and with less shortness of breath. This training also assists individuals in regaining breathing control rapidly after a period of strenuous exercise. This is, of course, important in performing effectively over the course of an entire game or match. In addition to this, having control over one's breathing can be of psychological importance. Following a period of strenuous play, for instance an attacking manoeuvre in football or rugby, or a long rally during a game of tennis, appearing to be fresh and in control of one's breathing can be demoralising for one's opponents, and lends an air of invincibility.

The development of the muscles around the lungs of a subject, particularly the subject's extrinsic muscles, allows the subject to expand his or her lungs rapidly and significantly following exercise, leading to fast and effective re-oxygenation of the subject's blood. This allows the subject to bring his or her breathing under control quickly.

The benefits of training embodying the present invention are not limited to strenuous competitive sports. The training can also be very helpful for those involved in dance, acting, public speaking and so on. The training regime may be taught to individuals who might use the regime through a training movie on a videotape or DVD or other recorded media or on a website from which the movie may be downloaded or streamed, for example. Alternatively, the training regime may be taught to individuals in a book, brochure, or other printed material. The training materials may include written and/or verbal descriptions of the steps and may include pictures, drawings or videos demonstrating the performance of the steps such as one or more of the swimming techniques and/or one or more of the stretch positions.

More specific examples of training regimes embodying the present invention will now be described.

For a relative beginner, a first training regime might comprise the following steps. This example is carried out in a 25-meter swimming pool.

1. In the swimming pool, the subject places both hands on the side of the pool, or on an eye-level bar at the side of the pool. The subject's hands should be 8-12 inches apart, and the face should be looking straight ahead.
2. A controlled breath is inhaled and held for at least 10 seconds, before being released under steady control. This should be repeated at least 3 times.
3. After the $4^{th}$ intake of breath, a series of stretch and hold exercises should commence, for instance as shown in FIGS. 1-12, in which the subject is underwater and the arrow points toward the surface of the water. These exercises are preferably carried out with the subject's face submerged in the water, while still holding onto the poolside, such as the pool edge or pool deck, or bar.
4. After resurfacing with controlled exhalation of breath (to avoid hyperventilation), steps 1 and 2 are repeated.
5. Following inhalation of a breath, the subject swims a length of the pool, holding the breath and without inhalation or exhalation during the completion of the length. The length is swum using a specific technique, involving a long "freestyle"-type arm action, but with no leg movement (this technique has been found to reduce surface drag significantly).
6. Once the length has been completed, the subject once again places his/her hands on the poolside or bar, and the breath is exhaled under complete control. This is followed by another controlled deep breath, held for as many seconds as can reasonably be managed (typically 3-4 seconds).
7. A further 14 lengths are then swum, using the same technique as outlined above, and again holding an inhaled breath for the duration of the length. Following each length, slow inhalation and release of breath, under complete control, should be repeated 3 or 4 times. This has the effect of increasing the length of time for which the breath can be held in comfort, and this time should increase to 15-20 seconds.

Figure 13:
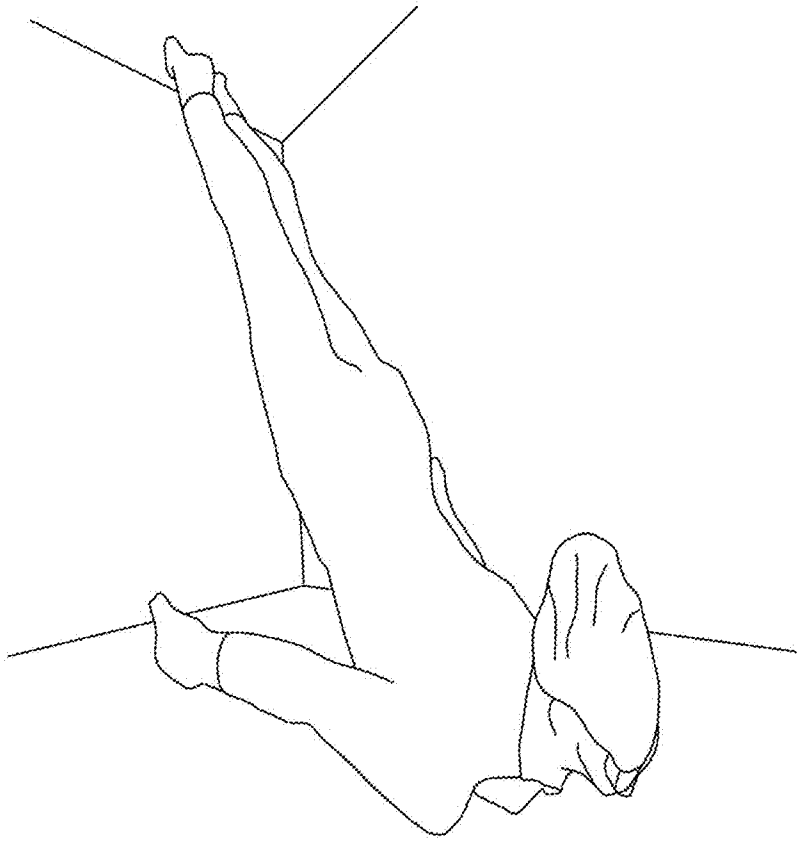
FIGS. 13 to 15 show stages in a swimming action that is suitable for use with the present invention.
Figure 12:
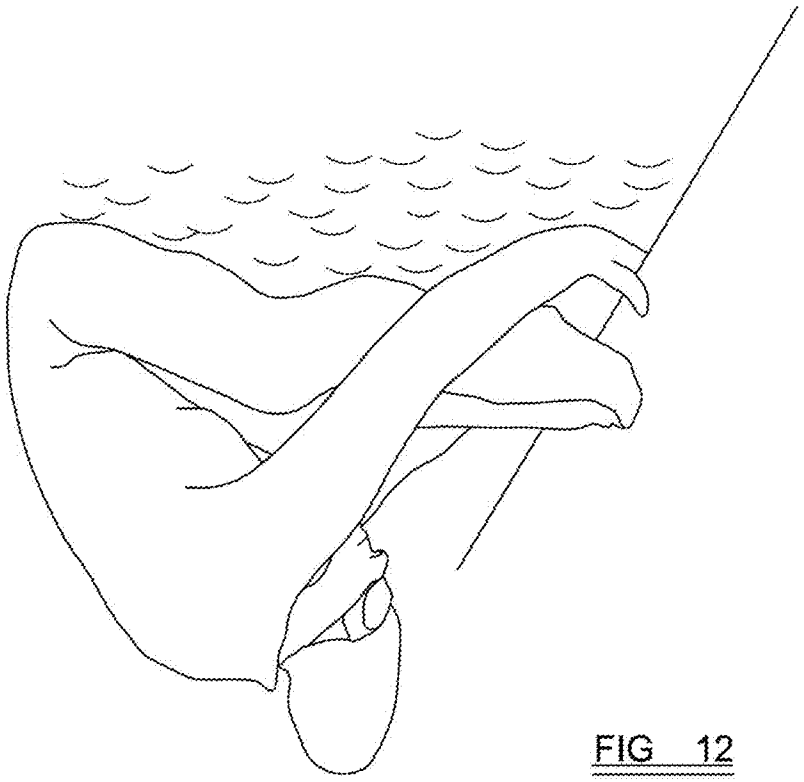
Figure 15:
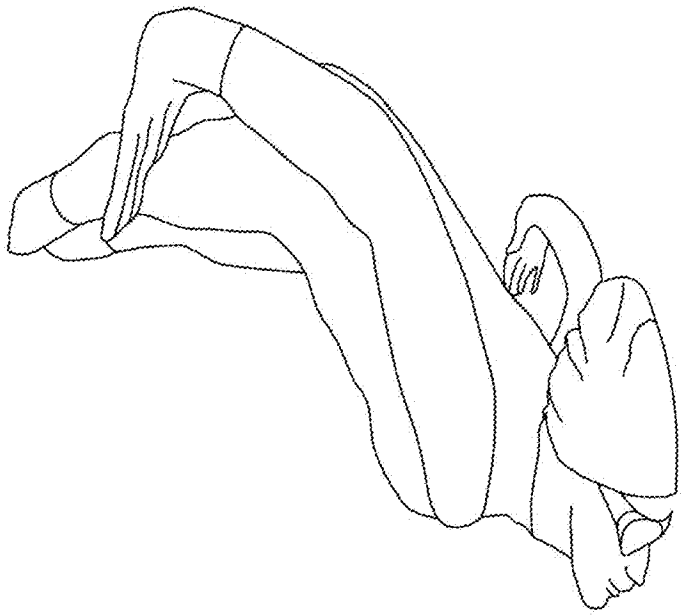
Figure 14:
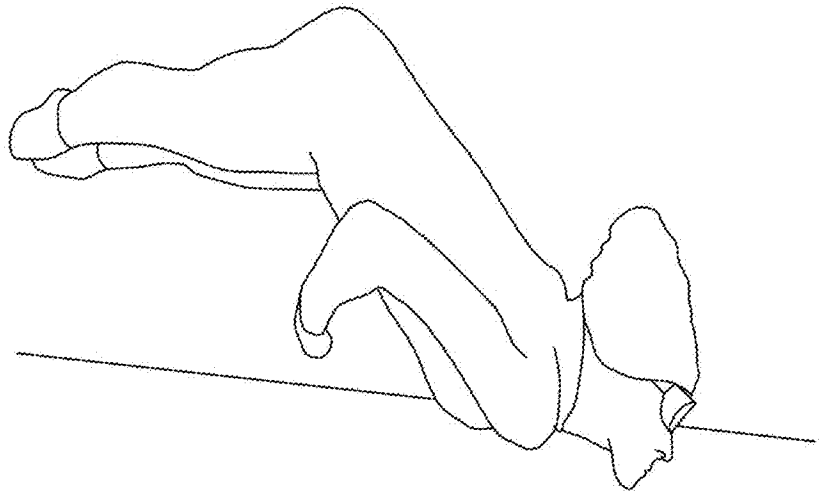

A second, more advanced training regime embodying the invention is as follows, again carried out in a 25-meter swimming pool. A subject will generally be ready to progress to this more advanced regime following a period of training under the first regime set out above. The more advance regime comprises the following steps:

1. In the swimming pool, the subject places both hands on the side of the pool, or on an eye-level bar at the side of the pool. The subject's hands should be 8-12 inches apart, and the face should be looking straight ahead.
2. A controlled breath is inhaled and held for at least 10 seconds, before being released under steady control. This should be repeated at least 3 times.
3. A deep breath is then inhaled, and the subject descends to the bottom of the pool and swims a length along the bottom of the pool. The length is swum using a specific sculling technique, in which the subject swims face down, using sculling arm movements only, with the subject's legs stretched out behind him/her, with feet pointed together (i.e. the legs again do not participate in the swimming action). Stages of this action can be seen in FIGS. 13-15, in which the subject is underwater and the arrow points up.
4. At the end of the length, the inhaled breath is released under absolute control.
5. A series of stretch and hold exercises is then carried out, again for instance as shown in FIGS. 1-12. The majority of these exercises are carried out with the subject's face submerged in the water, while still holding onto the poolside or bar.
6. On completion of these exercises, normal breathing returns. Following this, a further underwater length is swum, as in step 3, again followed by exercises as in step 5.
7. Step 6 is repeated until a total of 25 lengths have been swum.

When a subject is able to carry out 25 lengths according to the first training regime, followed by 25 lengths according to the second training regime, the subject is ready to tackle a third, yet more advanced, training regime. The third regime involves carrying out lengths, effectively as set out in the first training regime, followed by further lengths, effectively as set out in the second training regime, although this time in a 50-meter pool, instead of a 25-meter pool.

Those skilled in the fields of training and development will realize that the regimes set out above may be varied to include, for example, more or fewer exercises, more or fewer lengths, different exercises, different distances swum and different swimming techniques, while still retaining the benefits of the invention. It is important, however, that training regimes embodying the present invention include both the first step and the second step, carried out successively without a significant rest therebetween.

The inventor has found that training regimes embodying the invention result in dramatic improvements in breathing capacity and effectiveness, far in excess of what would be expected simply from carrying out repeated swimming exercises while holding one's breath. The particular combination of physical exertion, while holding an inhaled breath, and carrying out stretch and hold exercises, again while holding an inhaled breath, provides unexpected benefits which are significantly greater than would arise from carrying out either exercise independently.

The benefits of the training may accrue over time, and may be noticed primarily after carrying out the training for a period of a few weeks. For example, the training regimes may be performed as part of an exercise program, which may be performed at least once a week, or at least twice per week, over a period of time such as at least six weeks.

In the discussion above, reference is made to activities being carried out without air being inhaled or exhaled. Preferably, absolutely no inhalation or exhalation takes place during these phases.

In the discussion above, reference is made to activities being carried out without air being inhaled or exhaled. Preferably, absolutely no inhalation or exhalation takes place during these phases.

As discussed above, part of the training methods discussed herein require the subject to adopt and hold a stretch position while fully or partially submerged in water, and generally these stretch positions will be adopted at or near the side of swimming pool. As the skilled reader will appreciate from the attached figures, as part of all or most of these stretch positions it is necessary to hold onto a feature at the side of the pool while the stretch position is maintained. However, the features available to hold onto at the side of a swimming pool vary considerably from one pool to another, including the height of the pool edge above the level of the water (from very high pool edges to "infinity" pools, in which the edge may be below the level of the water), the shape of the angle where the vertical side of the pool meets the surrounding horizontal surface, the texture and/or grip properties of the vertical side of the pool and the surrounding horizontal surface, and the presence (or otherwise) of a bar or rail, or any other feature which may provide a handhold.

The inventor has found that, at most swimming pools, it is possible only to perform a limited subset of the stretch positions effectively.

In aspects of the invention, a device (referred to below as a "grab device") is used to provide a feature at or near the edge of a swimming pool, which will provide a reliable and suitable handhold for a person carrying out the training.

In preferred embodiments, the grab device is removably attachable to a surface at or near the edge of a swimming pool. Most preferably, the grab device is removably attachable to the vertical side of a swimming pool, either above or below the level of the water (or indeed at the level of the water).

The grab device may be removably attachable to the vertical side of a swimming pool by way of one or more suction mount-type fittings. As the skilled reader will understand, a suction mount fitting generally involves a deformable cup made from an elastic material. In use, the cup is placed against a surface and centre of the cup is pressed towards the surface, thus expelling fluid within the cup outwardly. When the centre of the cup is released, the cup will resume its original shape (or a shape which is close to its original shape), and will have lower pressure within the cup than the surrounding fluid pressure. This will lead to a reliable seal between the cup and the surface, and a strong resistance to the cup being pulled directly away from the surface.

Suction mounts can be provided with a lever or handle which selectively applies pressure to the cup, allowing a user to attach and detach the cup quickly and easily from a surface.

Examples of suction mounts with which readers will be familiar include the mounts that are often used to attach a satnav device to the interior of a vehicle windscreen. Suction mounts of this kind also work underwater, and are used (for example) in the "Suction Cleat" sold by Budget Marine, which can be seen at www.budgetmarine.com.

A grab device suitable for use with the present invention may comprise a pair of suction mounts, with a bar or other structure extending between the suction mounts.

The preferred structure extending between the suction mounts is a bar of a suitable size to be easily grasped and held by a user. In preferred embodiments, the bar may have a diameter of around 2 to 3 inches (although other sizes may also be used if desired). The bar is preferably positioned with respect to the suction mounts so that, when the suction mounts are connected to a surface, the bar is positioned at a distance of around 3 to 4 inches from the surface. This distance will allow a user to grasp the bar with his/her hand, and for there to be sufficient clearance between the bar and the surface for this to be possible, without the bar protruding away from the surface more than is necessary. Again, the bar may be set at a different distance from the surface (in particular, a greater distance) where this is preferred by a user, for instance to perform particular kinds of stretches.

It is preferred that the bar is of sufficient length that the user may grasp the bar with both hands to perform stretches, with the user's hands at least shoulder-width apart. The bar is at least 1 metre in length, and is preferably at least 1.5 metres in length, for users with wide shoulders and/or long arms, or for performing particular stretches, a longer bar may also be used.

It is preferred that the bar is of a constant cross-sectional shape along its length (which is preferably circular cross-sectional shape), so that it may be easily grasped by a user at any position. However, in other examples the bar may have one or more grab features provided therealong, to provide a stable handhold at a set position along the bar. For instance, a grab feature may comprise a pair of raised ribs or ridges 20, set at a suitable distance apart (such as around 5 to 6 inches) so that a user may grab the bar between the ribs or ridges 20, and the ribs or ridges 20 will help to prevent the user's hand from sliding along the bar.

In some embodiments the bar is generally C-shaped, turning through an angle at each end to be connected to a suction mount. It is preferred that the bar is smoothly curved where it turns through an angle, as this will assist the user in holding on to the bar comfortably.

While preferred embodiments involve a bar which is generally cylindrical and of constant cross-sectional shape along all or substantially all of its length, the bar may also take any other suitable configuration. For instance, the bar may involve at least one section which is set at an angle to at least one other section, and/or may involve at least one section which is parallel or substantially parallel with at least one other section, but is offset with respect thereto. These shapes may be adapted to suit the style or body type of a particular user, or may be adapted to be particularly suitable for holding whilst performing one or more stretch position.

Figure 16:
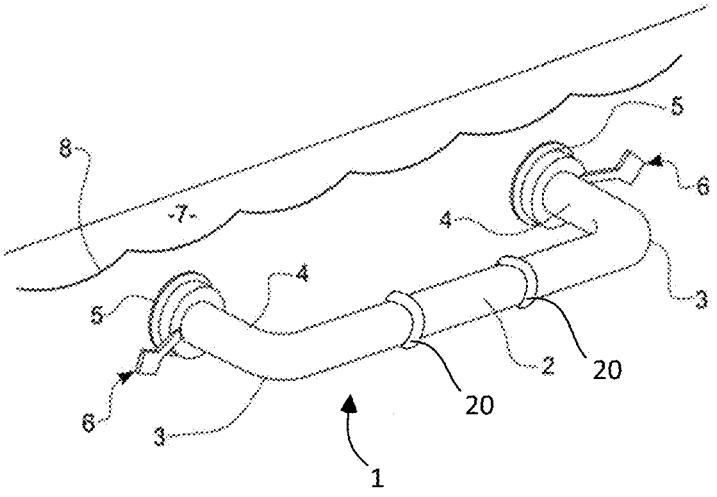
FIG. 16 shows a grab bar suitable for use with the present invention.

An exemplary grab bar 1 is shown in FIG. 16. The grab bar 1 has a main elongate section 2, which is generally straight and of cylindrical shape, having a constant diameter along this section 2. At each end of the elongate section 2 is a curved transition section 3, which bends through 90° and leads to a respective connection portion 4. The connection portions 4 are parallel and of equal length, and terminate in respective suction mounts 5. Each suction mount 5 is preferably as described above, and in the example shown includes a lever 6 to facilitate attachment and removal of the suction mount 5.

The suction mounts 5 may be used to attach the grab bar 1 to a vertical side surface 7 of a swimming pool. In FIG. 16 the grab bar 1 is shown mounted below the level of the waterline 8, although the grab bar 1 may equally be mounted above the waterline 8, or at substantially the same level as the waterline 8.

In other embodiments, two grab devices may be provided, one for each of the user's hands. Each grab device may comprise one or more suction mounts, with a handle of a suitable kind connected thereto, and the skilled reader will appreciate the form that a handle of this kind may take. A user may use two or more of these handles in a training session—for instance, one pair of handles may be set with a relatively wide spacing therebetween, suitable for carrying out the stretch position shown in FIG. 5, while a further pair of handles may be set at a relatively narrow spacing therebetween, suitable for carrying out the stretch position shown in FIG. 9.

In use, a user may have two grab devices comprising elongate bars, as discussed above. Prior to beginning a training session, the user may attach each bar at one end of a swimming pool, at a desired height. Each bar may be placed below the level of the water, above the level of the water, or at or substantially at the level of the water. In preferred embodiments, each bar is set to be level, or substantially level, with the surface of the water. If two bars are used, the bars may be set at different heights from each other. If two bars are used, then the bars are preferably positioned directly opposite or substantially opposite each other across the length or width of the swimming pool.

In other embodiments, only one bar may be used.

A grab device comprising a bar, as discussed above, is preferably formed to be light and easy to carry. The material from which the bar is formed is preferably a lightweight and robust plastic material. While sturdier materials such as aluminium are also contemplated, it is expected that these materials will be excessively heavy. The material from which the bar is formed must also be resistant to water, particularly chlorinated water and/or seawater (depending on the circumstances in which the bar will be used).

In preferred embodiments the bar is formed from two or more telescopic sections, which allows the bar to be collapsed in length so that it can be carried easily, particularly in a rucksack or gym bag.

Bars and other grab devices for use with the present invention are also preferably adapted to be easy to see underwater. This is particularly useful as goggles worn by a user may become misted over during use, and/or may introduce distortion to the user's field of view. Accordingly, the grab devices may have a fluorescent or otherwise striking colour, particularly which may easily be seen against the wall of a swimming pool, which is likely to be a white or pale blue colour. In advantageous embodiments of the invention, all or some of the grab device may be fluorescent or bright yellow, orange, red or pink. The grab device may also have a striking contrast of colours, for instance stripes of black and fluorescent yellow.

Both the suction mounts and the remainder of the grab device may be coloured in this way. However, in other embodiments the suction mounts may be a black or neutral colour (allowing ready use of "off the shelf" suction mounts), while the bar or other part of the grab device is strikingly coloured.

Once the grab device(s) have been put in place, the user then commences a training session, as described above. Where stretch positions are adopted, the user will hold the grab device with one or both hands. The skilled person will understand that this will assist in the adoption and holding of the stretch positions.

Once the training session is complete, the grab devices are removed.

While the above discussion involves a grab device which is attachable directly to the vertical side of a pool, other kinds of grab device are envisaged. For example, an alternative grab device may be attachable to the horizontal surface surrounding the pool (again through one or more suction mounts), and may then have one or more arms which extend downwardly over the side of the pool and have a bar, or other grab feature (as discussed above) at or near the end of the/each arm. The or each arm may be telescopic, or otherwise be of adjustable length, so the height of the bar with respect to the surface of the water can be controlled by the user.

As an alternative to suction mounts, the device may have one or regions of high-friction material (such as rubber or a similar material), which may grip against the horizontal surface surrounding the pool.

One aspect of the invention provides a kit, comprising two grab devices as described herein, so that the two grab devices can be positioned at opposite ends or sides of a swimming pool. The kit may further comprise a bag or other carrier, preferably with pockets or other arrangements for holding the two grab devices. The kit may comprise more than two grab devices, particularly whether the grab devices are each adapted to be grabbed with one hand only.

In preferred embodiments, a timing device is provided, which assists the user in timing the stretch exercises. As the skilled reader will appreciate, when carrying out the stretch exercises when physically tired and short of oxygen, it may be difficult for the user to count seconds reliably.

The timer preferably takes the form of a device which is worn by the user, or otherwise attached to the user's body. Most preferably, the timer takes the form of a watch or similar device which is removably attachable to the user's wrist.

As the reader will appreciate, in many of the stretch positions the user cannot see his/her wrist easily, or would need to move from the stretch position to see his/her wrist. It is therefore preferred that the timer is able to provide the user with timing information that does not require the user to look directly at the timer.

As one example, the timer may provide the user with haptic signals, for instance pulses or vibrations which can be sensed by the user's skin.

In one embodiment, the timer has a button or other control which the user can activate to begin a stretch position. The user then adopts the stretch position, and the timer provides a haptic signal at regular intervals, e.g. once per second. This will allow a user to time the stretch position easily, without having to look at the timer. As an alternative, the user may program the timer to set the length of time for which the stretch will be held, for instance 5 seconds. The user may then activate the control, and adopt the stretch position, and the timer will provide a haptic signal after the pre-set length of time.

Many other signal timings are possible, as the skilled reader will appreciate.

As an alternative to haptic signals, the timer may emit a bright light, which can be seen by the user through reflection of the light from the pool floor, walls or other surfaces if the light cannot be seen directly by the user. The bright light may be emitted for a short pulse once per second, for example. This is less preferred than haptic signals, however, since the light may be difficult to see reliably, and also this may be distracting for other users of the pool, particularly other users of the pool who may be carrying out similar training.

Instead of taking the form of a watch or similar device, the timer may be configured so it may be affixed to the user's leg, chest, or any other body part. However, it is expected that a wrist mounting will be most convenient, and least intrusive for the user's swimming.

In preferred embodiments the timer may also be configured to time the lengths which are swum by the user. In the training methods disclosed herein the focus is generally not on swimming the lengths as fast as possible, and the timer may provide a signal to the user (again, preferably a haptic signal) if the user is swimming too quickly or too slowly during the swimming of the lengths. The upper and lower speed thresholds are preferably adjustable by the user.

The timer may have controls which allow the user to switch between a "swimming lengths" mode and a "stretch" mode, and the skilled reader will appreciate how this may be configured.

Figure 17:
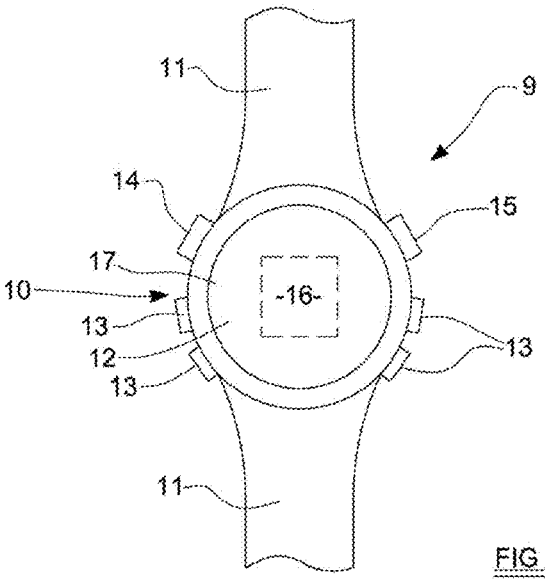
FIG. 17 shows a timing device suitable for use with the present invention.

An exemplary timing device 9 is shown in FIG. 17. The timing device 9 generally takes the form of a sports watch, having a main body 10 and a strap 11, which is only partially shown, but which is configured to encircle and be fastened around a user's wrist in any suitable way. The main body 10 includes a face 12 comprising a display 17, which (as the skilled reader will understand) may show information relating to a current training session, as well as other general information such as the time, date etc.

The timing device 9 comprises some first controls 13 in the form of buttons arranged around the perimeter of the main body 10. Additionally, or alternatively, the first controls may be provided on the front of the main body 10, or in any other suitable location. The first controls need also not take the form of buttons, and any suitable input arrangements (such as a touch screen) may also be used. The first controls 13 may be used to control certain functions of the timing device 9, and to input information to the timing device 9.

The timing device 9 further comprises a "length" control button 14 and a "stretch" control button 15. In the example shown these buttons 14, 15 are larger and more prominent than the first controls 13, as these buttons 14, 15 are intended to be operated quickly and under physical stress. However, this need not be the case, and again these controls may be mounted anywhere on the timing device 9, and need not take the form of buttons.

The "length" control button switches the timing device 9 to a mode in which the timing device 9 times how long the user takes to swim one or more lengths (or widths, as appropriate) of a pool.

The "stretch" control button switches the timing device 9 to a mode in which the timing device 9 times how long the user holds a stretch position for, and (as described above) the timing device preferably delivers a haptic signal to the skin of the user (by way of a haptic signal generator 16, which may for example be a vibration device built into the body of the timing device 9).

During either or both modes, the duration of the length or stretch position may be displayed on the display 17 of the timing device 9.

In some embodiments the timing device 9 may include one or more accelerometers or other motion sensors, which will allow the timing device to determine how the timing device 9 is being moved and/or the orientation (with respect to gravity) of the timing device 9, at any moment. In these embodiments, the timing device 9 may be configured to switch automatically between a "length" mode and a "stretch" mode.

When the user is swimming, the accelerometers of the timing device 9 will show that the timing device 9 is being moved in a repeated pattern, with a relatively constant frequency (this will be true regardless of the stroke which is employed by the user, even if the user makes no, or minimal, use of his/her arms). The timing device 9 will therefore be able to determine when the user is swimming a length. By contrast, when the user adopts and maintains a stretch position, the timing device 9 will register very little or no motion.

A user may therefore engage a mode on the timing device which is adapted to monitor the training. The user can then alternate between swimming lengths and holding stretch positions, as discussed above. While the user is swimming, the timing device 9 can detect this, and record the length of time taken to swim the length (if the user enters the length of the pool, the timing device 9 can also determine the user's speed). When the user adopts and holds a stretch position, the timing device 9 can detect this and monitor the length of time for which the stretch position is held, and during this phase of the training can also deliver haptic signals to the user, as discussed above. No active input or operation of controls will be needed by the user as the training progresses, to switch the timing device 9 between these two modes. In such embodiments the timing device 9 may not include dedicated "length" and "stretch" controls.

As the skilled reader will appreciate, some currently-available waterproof sports watches have all of the physical components—such as suitable controls, accelerometers, the ability to provide haptic feedback, and a suitable processor to control the components of the watch—required to fulfil the role of the timing device, for instance the Apple Watch™ Series 2 (although there are several other examples). It is envisaged that, through suitable programming, a sports watch of this kind can function as a timing device in accordance with the present invention. One aspect of the invention comprises a computer program which, when executed on a suitable sports watch, causes the sports watch to fulfil the function of a timing device in accordance with the invention. Such a computer program may be provided in the form of an "app" or similar, which may be downloaded from a central provider such as the Apple App Store.

The time preferably records the length of time for which each stretch position is held and/or the time taken for each length to be swum, and may also (or alternatively) record the number of stretches and/or lengths which are performed. This data may be kept by the user, as a record of the training which can be viewed at a later date. The data may be transferrable from the timer to a further device, such as a computer, mobile phone or tablet, where the data can be viewed and analysed in different forms.

When used in this specification and claims, the terms "comprises" and "comprising" and variations thereof mean that the specified features, steps or integers are included. The terms are not to be interpreted to exclude the presence of other features, steps or components.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilized for realising the invention in diverse forms thereof. In the foregoing detailed description, the invention has been described with reference to specific embodiments. However, it may be appreciated that various modifications and changes can be made without departing from the scope of the invention.

What is claimed is:

1. A method for improving respiratory effectiveness of an individual, comprising the steps of:

a) providing a grab device, comprising two removable mounts, configured to allow the grab device to be removably attached to a surface of, or near, a swimming pool, wherein the grab device further comprises an elongate bar extending between the two removable mounts, wherein the two removable mounts comprise suction mounts, the grab device being telescopic;

b) attaching the grab device to the surface of, or near, the swimming pool so that the elongate bar is horizontally elongated in a direction parallel to a side surface of the swimming pool;

c) inhaling a first breath and, while continuously holding the first breath, swimming in the swimming pool for a period of at least 10 seconds without exhaling or further inhaling;

d) providing a controlled release of the first breath;

e) inhaling a second breath and, without exhaling or further inhaling, adopting, and holding for a period of at least 3 seconds, at least one first stretch position, wherein a torso of the individual remains sufficiently straight such that expansion of the individual's lungs is not impeded while holding the at least one first stretch position, the at least one first stretch position requires constant muscular exertion by the individual to maintain the at least one first stretch position, and wherein the individual holds the elongate bar of the grab device with both hands for all or part of the period for which the at least one first stretch position is maintained;

f) providing a controlled release of the second breath;

g) inhaling a third breath and, while continuously holding the third breath, swimming in the swimming pool for a period of at least 10 seconds without exhaling or further inhaling;

h) providing a controlled release of the third breath; and i) inhaling a fourth breath and, without exhaling or further inhaling, adopting, and holding for a period of at least 3 seconds, at least one second stretch position, which is different from the at least one first stretch position, wherein the torso of the individual remains sufficiently straight such that the expansion of the individual's lungs is not impeded while holding the at least one second stretch position, the at least one second stretch position requires constant muscular exertion by the individual to maintain the at least one second stretch position, and wherein the individual holds the elongate bar with both hands for all or part of the period for which the at least one second stretch position is maintained.

2. The method according to claim 1, wherein the surface of, or near the swimming pool is a vertical surface at an edge of the swimming pool.

3. The method according to claim 2, wherein the vertical surface at the edge of the swimming pool is a vertical surface below a water level in the swimming pool.

4. The method according to claim 1, wherein step a) further comprises providing an additional grab device comprising two removable mounts, configured to allow the additional grab device to be removably attached to a second surface of, or near, the swimming pool, wherein the additional grab device further comprises an elongate bar that extends between the two removable mounts of the additional grab device, wherein step b) further comprises attaching the additional grab device to the second surface of, or near, the swimming pool, such that the grab device and the additional grab device are attached at locations which are opposite one another across a length or width of the swimming pool.

5. The method according to claim 1, wherein step c) comprises swimming underwater or swimming along a water surface.

6. The method according to claim 1, wherein the at least one first stretch position comprises two or more stretch positions, each of the two or more stretch positions being held for at least 3 seconds.

7. The method according to claim 1, wherein step c) and step e) are alternately carried out at least 10 times each.

8. The method according to claim 1, wherein the grab device has a pair of raised ribs or ridges spaced apart from each other, wherein when the individual holds the elongate bar of the grab device during steps e) and i), the individual grabs the elongate bar between the ribs or ridges so as to limit the individual's hands from sliding along the elongate bar.

* * * * *